United States Patent [19]

Schneiderman

[11] Patent Number: 4,889,336

[45] Date of Patent: Dec. 26, 1989

[54] EXERCISE DEVICE

[76] Inventor: Simon Schneiderman, 473 Sackville Avenue, Toronto, Ontario, Canada, M4X 1T5

[21] Appl. No.: 277,205

[22] Filed: Nov. 29, 1988

[51] Int. Cl.[4] ..... A63B 21/02

[52] U.S. Cl. ..... 272/137; 272/142; 272/139

[58] Field of Search ..... 272/137, 139, 142, 126, 272/135

[56] References Cited

U.S. PATENT DOCUMENTS

| | | | |
|---|---|---|---|
| 2,097,376 | 7/1936 | Marshman | 272/139 |
| 2,224,103 | 6/1939 | Nilson | 272/137 |
| 3,162,441 | 2/1960 | Karlik | 272/139 |
| 4,033,580 | 7/1977 | Paris | 272/137 |
| 4,057,246 | 11/1977 | Wilson | 272/137 |
| 4,121,827 | 10/1978 | Weider | 272/137 |
| 4,552,356 | 11/1985 | Brousseau | 272/137 |

OTHER PUBLICATIONS

Black Belt Magazine, May 1986, "Iso-Kick", p. 116.

*Primary Examiner*—Richard J. Apley
*Assistant Examiner*—J. Welsh

[57] ABSTRACT

A martial arts development device having first and second arm cords with hand attachments at their free ends, longitudinal leg cords shorter than the arm cords with foot attachments at their free ends, a junction connecting the arm cords and the leg cords at a junction point, and a transverse foot cord extending between the free ends of the leg cords, and the arm cords, leg cords, and foot cord being of an elastomeric material.

9 Claims, 2 Drawing Sheets

EXERCISE DEVICE

The invention relates to an exercise device and training aid for use in developing skills in the martial arts and boxing.

BACKGROUND OF THE INVENTION

Development of skills and strength for the martial arts (including boxing) involves exercising and development of the muscles both of the arms and the legs. These may be used separately or may be used simultaneously, and a training aid will preferably be universal in nature so that it may assist in the development of either the arms or the legs, or both the arms and the legs simultaneously.

Such a training aid should, to some degree, increase the muscular effort required beyond the actual conditions of a martial arts contest. Clearly it is not possible for such a training aid to simulate an actual contest with an opponent. However, it should as far as possible be able to assist in the development of the strength required to apply the various movements and blows, both of the arms and the legs, involved in martial arts contests.

Preferably, such a training aid should be capable of being used by an individual in his own home, or in a gymnasium, without the cooperation of an opponent. Preferably also, it should be of reasonable cost, and of a high degree of reliability and safety. It should also, as far as possible, be adaptable to persons of different size, or at least within a range of sizes.

In the past, devices have been proposed for exercising the body usually in various more or less specific exercises.

For example, U.S. Pat. No. 3,162,441 illustrates a device which can be attached to the wrists and ankles. Various different arm exercises can be practised and various different leg exercises can be practised. However, the stresses developed by this device for both leg and arm exercises are of relatively limited value for martial arts exercises. This appears to be because the device depends upon an attachment of the device to the abdomen, so that all stresses are developed in a direction extending from the abdomen to the ankles or to the wrists.

U.S. Pat. No. 2,097,376 illustrates a device having generally similar principles, and subject to the same limitations.

U.S. Pat. No. 4,057,246 illustrates a device of a simpler design. In this device, two sets of elastic cords of equal length are united at a centre point, in a tubular support, so that they form a letter "H". Foot stirrups and hand grips are provided, and it is suggested that exercises may be performed with the hands holding the hand grips and also with the hands holding the tubular support. There is no suggestion in this patent of using the device for exercising leg movements.

U.S. Pat. No. 4,033,580 illustrates a device somewhat similar to the previous device. In this case, the device is formed of a one-piece moulding of an elastic material so that there are arm portions and leg portions of equal length, with foot stirrups and arm handles at their ends, the device forming more or less the shape of two inverted letters "V". Again, this device is intended to be slipped over the feet, and held with the hands in the respective stirrups and handles, and various exercises are illustrated.

However, this device appears to be intended for general physical development, and again would be unsuitable for the specific development of strengths for practising of martial arts skills and strengths. In particular, this device is unsuitable for practising both striking, or blocking, exercises with the arms, and kicking exercises with the legs in rapid sequence and the strengths required, which is a feature of martial arts training.

In addition, it is unsuitable for developing strengths required, for example, for rapid foot work, coupled with striking and block exercises by the arms.

U.S. Pat. No. 2,224,103 illustrates a somewhat more simplistic device. This consists of a single length of elastic cord, and two foot stirrups through which the feet may be passed. Simple leg exercises may be practised, typically being shown in the patent as a form of stride exercise.

This device is unsuitable for developing martial arts strengths using combinations of hand and foot movements in rapid sequence.

BRIEF SUMMARY OF THE INVENTION

With a view to providing an exercise device suitable for developing martial arts strengths involving rapid hand and foot movements, the invention comprises a martial arts development device, in turn, comprising:

first and second arm cords, hand attachments at the free ends of said arm cords, longitudinal leg cords, foot attachments at the free ends of said leg cords, junction means connecting said arm cords and said leg cords at a junction point and, a transverse foot cord extending between the free ends of said leg cords, and wherein said arm cords, said leg cords, and said foot cord are formed of an elastomeric material.

More particularly, it is an objective of the invention to provide such a martial arts development device wherein the arm cords are longer than the leg cords, and the junction point is located at a height in the region of the crotch or pelvis of the body.

More particularly, it is an objective of the invention to provide a martial arts development device having the foregoing advantages wherein said foot attachments comprise strap means adapted to be strapped around the instep of the foot, and adjustable fastening means for fastening said strap means around the instep.

More particularly, it is an objective of the invention to provide a martial arts development device having the foregoing advantages wherein said hand attachments comprise strap means adapted to be wrapped around the palm of the hand, and adjustable fastening means for fastening the same.

More particularly, it is an objective of the invention to provide a martial arts development device incorporating length adjustment means for said arm cords, and length adjustment means for said leg cords, and length adjustment means for said foot cord.

The various features of novelty which characterize the invention are pointed out with more particularity in the claims annexed to and forming a part of this disclosure. For a better understanding of the invention, its operating advantages and specific objects attained by its used, reference should be had to the accompanying drawings and descriptive matter in which there are illustrated and described preferred embodiments of the invention.

IN THE DRAWINGS

Figure 1:
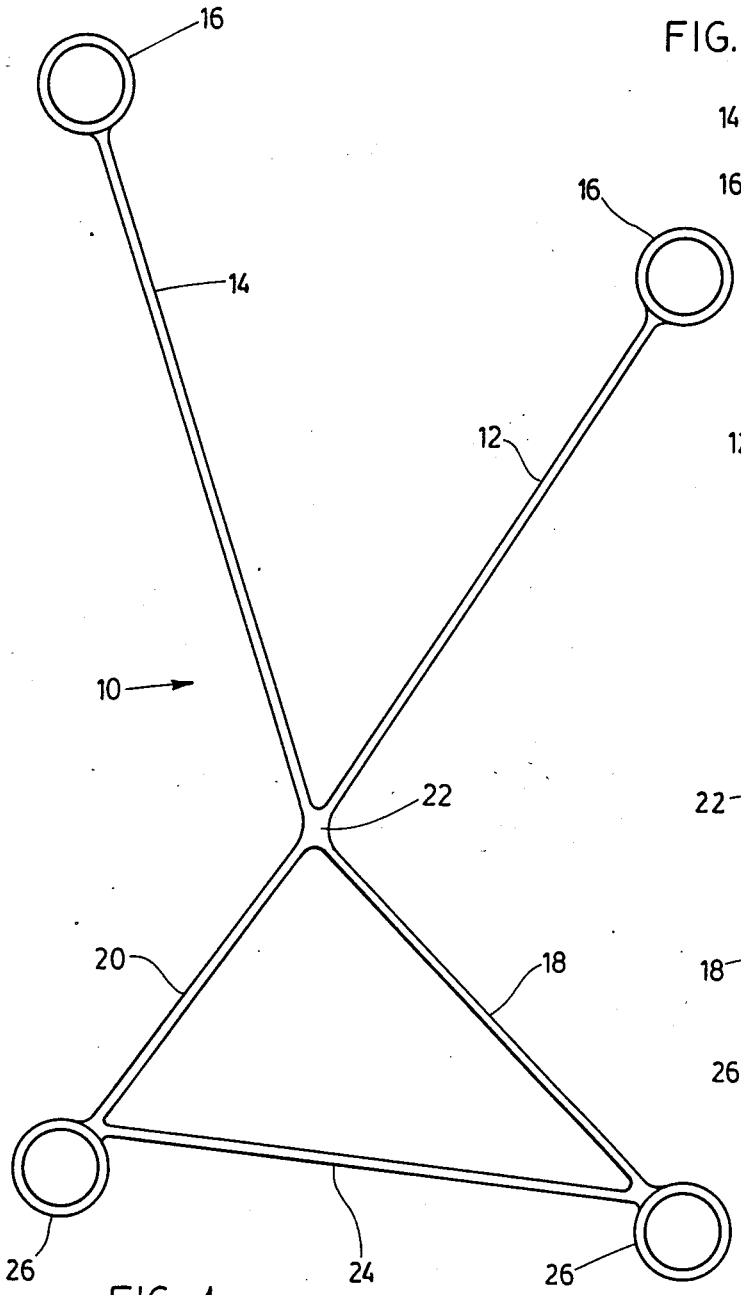
FIG. 1 is an elevational view of the martial arts exercise device in accordance with the invention.
Figure 2:
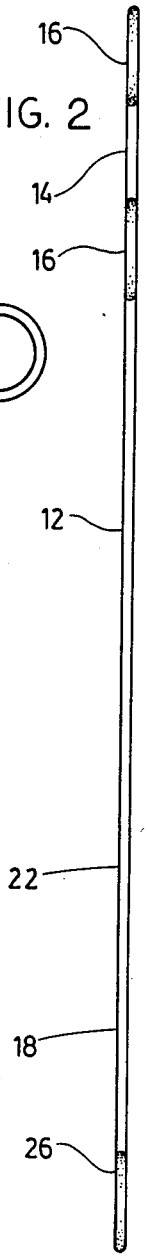
FIG. 2 is a side elevational view of the exercise device of FIG. 1.
Figure 4:
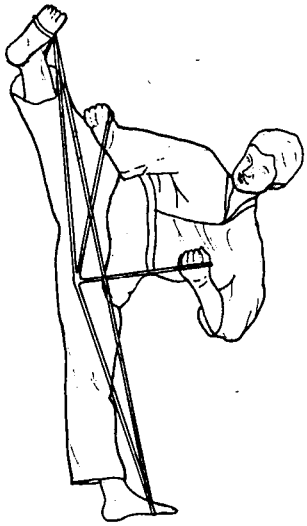

Referring first of all to FIG. 1, it will be seen that the invention is illustrated here in the form of a martial arts development device indicated generally as 10. The device 10, in turn, comprises arm cords 12 and 14. Hand attachments 16 are provided at the ends of cords 12 and 14 for attachment around the palm of the hand.

Leg cords 18 and 20 are provided, both being of a length less than the arm cords 12 and 14.

The arm cords 12 and 14 and leg cords 18 and 20 are joined at a common junction 22.

A transverse foot cord 24 extends between the free ends of leg cords 18 and 20.

Foot attachments 26 are provided on the free ends of leg cords 18 and 20.

Preferably, the hand attachments 16 and the foot attachments 26 should be such that they can be snugly fitted around the palms, and instep, of the hands and feet so that they do not have to be actually held by the practitioner.

Figure 3:
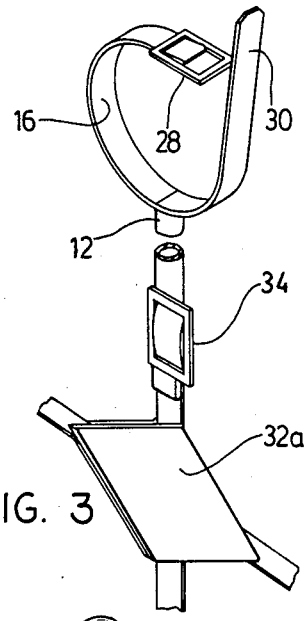
FIG. 3 is a perspective of an alternate embodiment illustrating a hand or foot attachment device; and, FIGS. 4, 5, 6 and 7 are illustrations showing the exercise device in use in various exercises.
Figure 5:
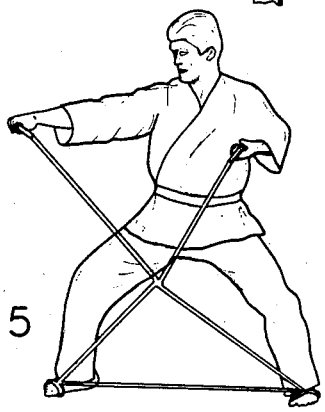
Figure 6:
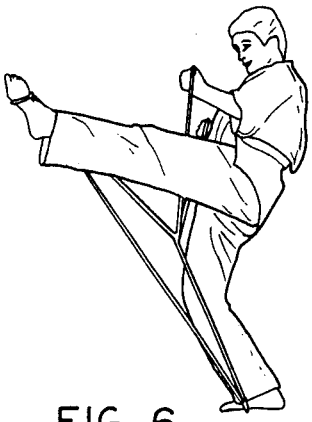
Figure 7:
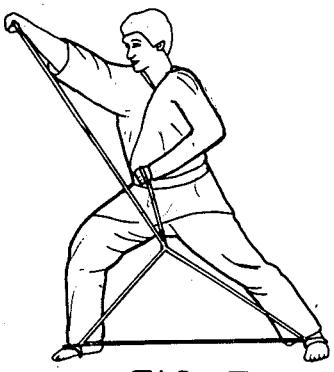

As illustrated in FIG. 3, the cords 12, 14, 18 and 20 are preferably formed of tubular elastomeric material, such as latex tubing, such as is used in the health care industry. Such tubing is of high quality latex and has a high degree of extension.

Preferably, in order to provide a secure form of attachment to the hands and feet, the attachments 16 and 26 will be in the form of adjustable straps as shown in FIG. 3. Such straps may have free ends which are provided with fastening means such as "VELCRO" (trade mark) or the like fastening means indicated as 28 and 30. In this way, the attachment means 16 can be wrapped tightly around the palm of the hand and securely fastened.

It will be appreciated that while FIG. 3 illustrates attachment means 16 on cord 12, the attachment means 16 on cord 14, and the attachment means 26 on cords 18 and 20 would also be of the same design, illustrations thereof being omitted for the sake of clarity.

As illustrated in FIGS. 4 to 7, foot exercises can be performed with either foot, and arm exercises or hand blows can be practised with either arm.

In each case, it will be noted that by reason of the arrangement of the length of the cords, the stresses developed by the device on the muscles of the arm or leg, which is actually applying the simulated blow, are forced to extend the cords a considerable distance, and thus cause muscle development where required.

As illustrated in FIG. 1, the lengths of the arm cords 12 and 14 and the leg cords 18 and 20, and the transverse cord 24, are preferably formed with a specific relationship. Preferably, the arm cords 12 and 14 will be of predetermined length, and the leg cords 18 and 20 will be of predetermined lengths shorter than the arm cords 12 and 14. One of the arm cords indicated as 14 may be somewhat longer than the other of the arm cords 12. Similarly, one of the leg cords 18 may be longer than the other of the leg cords 20.

In this way, the junction 22 is located at the height of the lower region of the body in the region of the crotch or pelvis. This location is found to produce the least interference with the various arm and leg movements which will be carried out.

In addition, the transverse cord 24 is preferably longer than the leg cords 20 and 18, thereby optimizing the kicking exercises with the feet, in typical martial arts development programs.

As already explained, the device may be used both for martial arts development programs and also for the development of muscles for boxing and the like, all of which are deemed to be included in the general term "martial arts" as used herein.

In some cases, in order to accommodate persons of different size, or persons having arms or legs of different lengths, the invention may also provide some form of length adjustment means.

In this case, as illustrated in FIG. 3, the adjustment means could be incorporated in the junction 32 of the device.

In FIG. 3, a junction device 32*a* is illustrated, having four adjustment buckles 34, through which the respective cords may be passed. In this way, it may be possible for persons of different sizes to adjust the length of the cords to suit themselves.

If desired, some form of length adjustment device (not shown) could also be provided in one or other ends of the transverse foot cord 24.

The foregoing is a description of a preferred embodiment of the invention which is given here by way of example only. The invention is not to be taken as limited to any of the specific feature as described, but comprehends all such variations thereof as come within the scope of the appended claims.

What is claimed is:

1. A martial arts development device comprising:
first and second arm cords:
hand attachments at the free ends of said arm cords;
longitudinal leg cords;
foot attachments at the free ends of said leg cords;
junction means connecting said arm cords and said leg cords at a junction point; and,
a transverse foot cord extending between the free ends of said leg cords, and wherein said arm cords, said leg cords, and said foot cord are formed of an elastomeric material.

2. A martial arts development device as claimed in claim 1 wherein said foot attachments comprise strap means adapted to be strapped around the instep of the foot, and adjustable fastening means for fastening said strap means around the instep.

3. A martial arts development device as claimed in claim 1 wherein said hand attachments comprise strap means adapted to be wrapped around the palm of the hand, and adjustable fastening means for fastening the same.

4. A martial arts development device as claimed in claim 1 incorporating length adjustment means for said arm cords, and length adjustment means for said longitudinal leg cords, and length adjustment means for said transverse foot cord.

5. A martial arts development device comprising:
first and second arm cords of predetermined lengths;
hand attachments at the free ends of said arm cords;
first and second leg cords of predetermined lengths less than said arm cords;
foot attachments at the free ends of said leg cords;

junction means connecting said arm cords and said leg cords at a junction point located at the height of the pelvic region of the body; and, a transverse foot cord extending between the free ends of said leg cords, and wherein said arm cords, said leg cords, and said foot cord are formed of an elastomeric material.

6. A martial arts development device as claimed in claim 4 wherein said foot attachments comprise strap means adapted to be strapped around the instep of the foot, and adjustable fastening means for fastening said strap means around the instep.

7. A martial arts development device as claimed in claim 6 wherein said hand attachments comprise strap means adapted to be wrapped around the palm of the hand, and adjustable fastening means for fastening the same.

8. A martial arts development device as claimed in claim 5 wherein said first and second arm cords are of predetermined length unequal to one another, and wherein said first and second leg cords are of predetermined lengths unequal to one another, and less than said arm cords.

9. A martial arts development device as claimed in claim 8 wherein said transverse foot cord is of a predetermined length longer than either of said first and second leg cords.

* * * * *